US005627336A

United States Patent [19]

Stevens

[11] Patent Number: 5,627,336

[45] Date of Patent: May 6, 1997

[54] PERCUSSION INSTRUMENT HAVING AN ELECTROMAGNETIC SENSOR

[75] Inventor: William L. Stevens, Janesville, Wis.

[73] Assignee: Nadene Isackson, Janesville, Wis.

[21] Appl. No.: 444,408

[22] Filed: May 19, 1995

[51] Int. Cl.[6] ..... G10H 1/32; G10H 3/00

[52] U.S. Cl. ..... 84/746

[58] Field of Search ..... 84/723, 725, 743, 84/746

[56] References Cited

U.S. PATENT DOCUMENTS 3,553,339 1/1971 Dominguez et al. ..... 84/725

4,104,945 8/1978 Bolin ..... 84/725

4,242,937 1/1981 Pozar ..... 84/725

5,063,821 11/1991 Battle ..... 84/743 X

*Primary Examiner*—William M. Shoop, Jr.

*Assistant Examiner*—Jeffrey W. Donels

*Attorney, Agent, or Firm*—Michael Best & Friedrich

[57] ABSTRACT

A musical instrument providing a base board, an elongated tone board mounted on the base board, the tone board having a first portion made of a material that is not ferro-magnetic and a second portion made of a ferro-magnetic material, a sensor mounted on the base board and providing a flux path and an output terminal, and a damper located between the tone board and the base board for isolating vibrations in the tone board from the sensor.

12 Claims, 2 Drawing Sheets

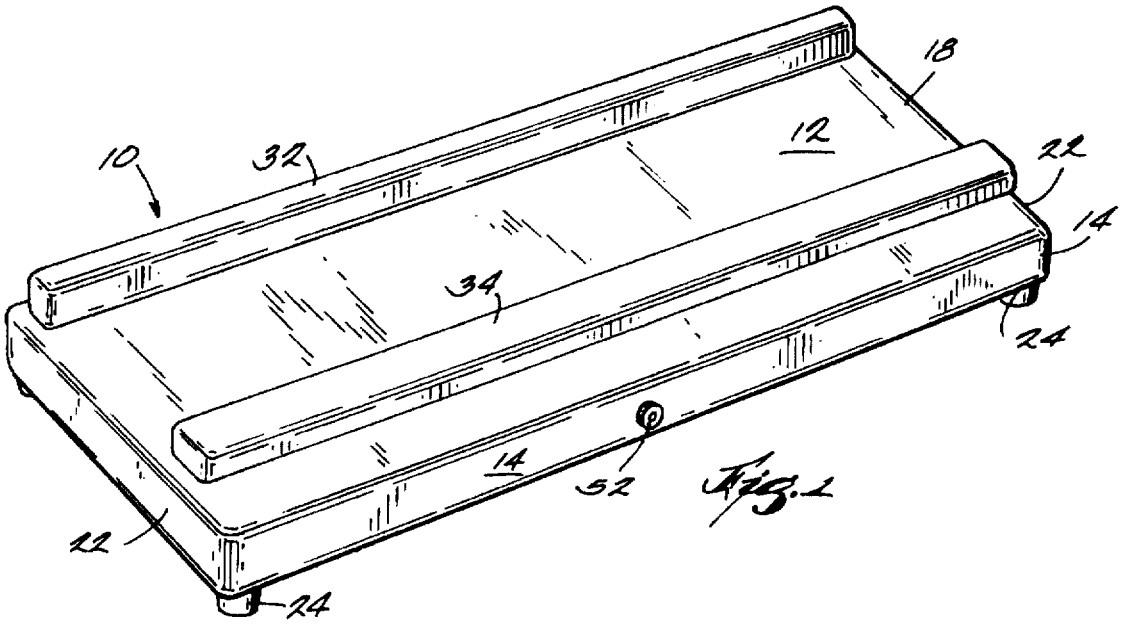
Fig. 1
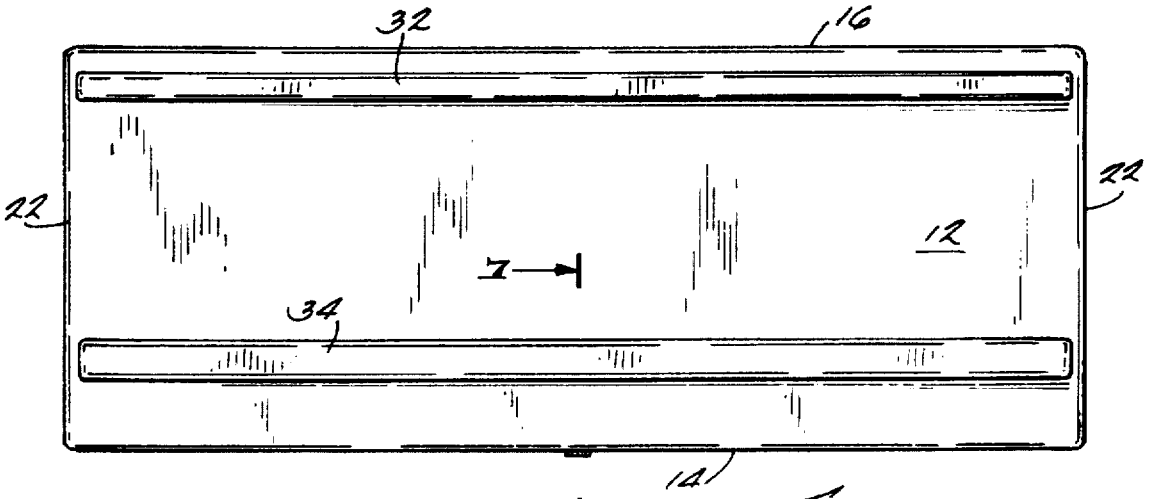
Fig. 2.
Fig. 3
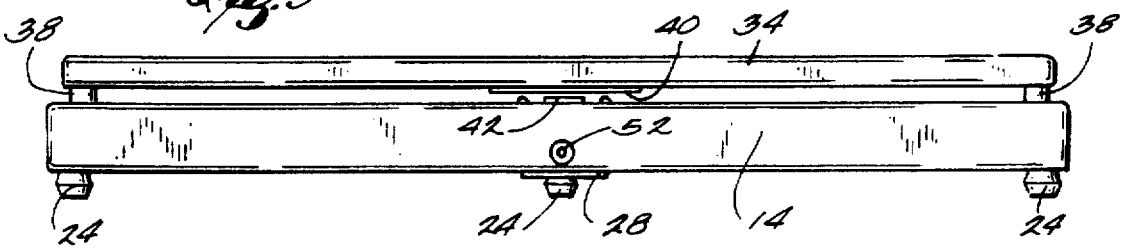

Fig. 4
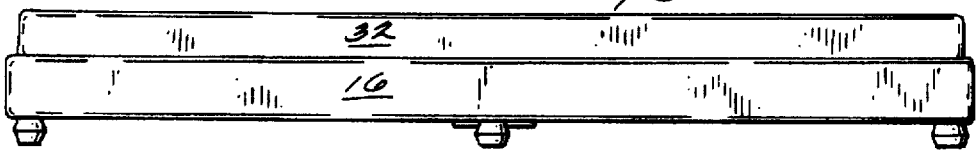
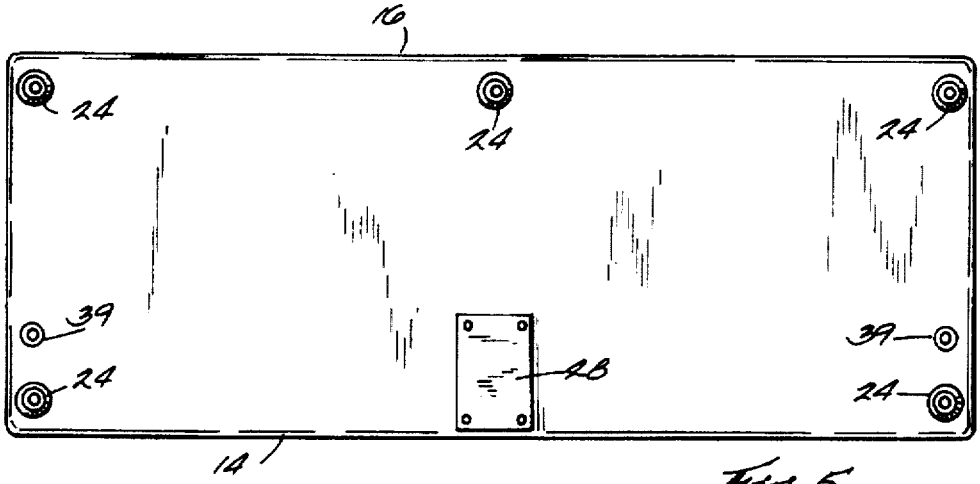
Fig. 5
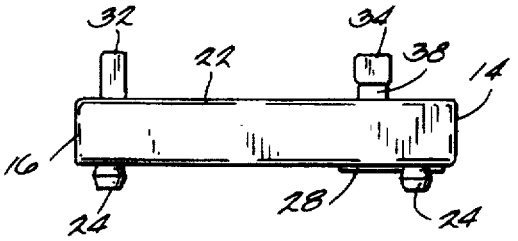
Fig. 6
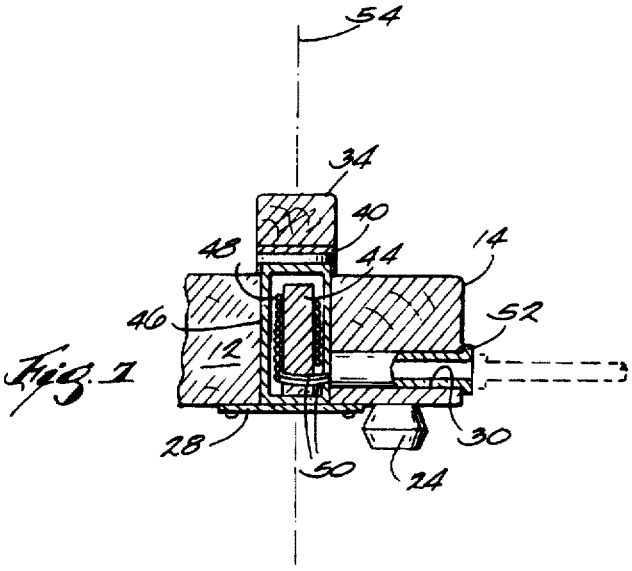
Fig. 7

PERCUSSION INSTRUMENT HAVING AN ELECTROMAGNETIC SENSOR

BACKGROUND OF THE INVENTION

1. Field of the Invention

The invention relates generally to musical instruments and particularly to percussion instruments.

2. Related Prior Art

It is generally known to provide musical instruments with various sensors or transducers to generate a signal in response to vibration of a portion of the instrument. For example, electric guitars are well-known, and typically include a sensor or "pick up" which generates a magnetic field. The magnetic field is sufficiently proximate a ferromagnetic guitar string such that, when the string is vibrated, it interrupts the magnetic field. The motion of the guitar string within the magnetic field creates an electric current in the coil that can be amplified.

It is also known to provide a percussion instrument including a relatively rigid member and a sensor mounted on the member for detecting vibration of the member. For example, U.S. Pat. No. 5,063,821, which issued to Battle on Nov. 12, 1991, discloses a percussion surface having a transducer that is operable to convert the mechanical vibrations of the percussion surface into electrical signals. The signals are used to trigger or activate a sound generation device.

SUMMARY OF THE INVENTION

One of the problems with such prior art musical instruments that incorporate magnetic sensors is that many such musical instruments include a sympathetic surface which vibrates harmonically with vibrations caused by the musician's playing the instrument. For example, the box part of an acoustic guitar can vibrate in unison with a plucked guitar string. This harmonic resonance can create a feedback signal when the guitar is used with amplification equipment. Also, in some instances, multiple electronic signal generators may be needed to produce tones having an acceptable quality and timber.

The invention provides a percussion instrument which can be easily played by a solo musician to add background rhythm to a performance without adding additional players or by using electronically generated tones. The invention provides tones which are produced by the vibrations of a hardwood tone board, which has been vibrated by the musician's input. The vibrations in the wood are detected by a passive sensor and converted into an electrical signal which is then amplified.

More particularly, the invention provides a percussion instrument including a solid hardwood base and tone board supported by the base for vibration relative thereto. The base board is isolated from vibrations in the tone board by vibration damping mounts. The instrument also includes a sensor housed within a cavity located in the base and a flux plate mounted on the tone board. The sensor includes a magnet that provides opposite poles lying along an axis extending through the tone board. The sensor also includes a coil surrounding the magnet. The musician can tap the tone board to vibrate the tone board. Vibratory motion of the tone board, i.e., deflection of the flux plate toward and away from the sensor along the axis, disrupts the magnetic field of the sensor and generates an electrical current in the coil. The current is conducted from the coil to an outlet and is used as a signal to drive an amplifier.

One aspect of the invention is the mechanical isolation of the magnetic sensor from the vibrations of the reciprocating tone board. This isolation results in the availability of the analog signals which can be amplified while retaining a high fidelity signal.

Other features and advantages of the invention will become apparent to those skilled in the art upon review of the following detailed description, claims and drawings.

BRIEF DESCRIPTION OF THE DRAWINGS

FIG. 1 is a perspective view of a musical instrument embodying the invention.

FIG. 2 is a top plan view of the instrument illustrated by FIG. 1.

FIG. 3 is a front elevation view of the instrument illustrated by FIG. 1.

FIG. 4 is a rear elevation view of the instrument illustrated in FIG. 1.

FIG. 5 is a bottom plan view of the instrument illustrated in FIG. 1.

FIG. 6 is a left side elevation view of the instrument illustrated in FIG. 1.

FIG. 7 is a cross-sectional view taken along line 7—7 in FIG. 2.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

The drawings illustrate a musical instrument 10. The musical instrument is a percussion instrument 10 useable by a musician to provide background rhythm. The instrument 10 includes (FIGS. 1–3) a generally rectangular support or base board 12 having a forward edge 14, rearward edge 16, upper and lower surfaces 18 and 20, and opposite ends 22. As best shown in FIG. 5, five rubber mounts 24 are fixed to the lower surface 20 of the base board 12. Preferably, the mounts 24 are made of rubber, such as neoprene and isolate the base board 12 from vibration in the surrounding environment by absorbing and damping such vibrations. The base board 12 has extending therethrough (FIG. 7) a sensor cavity 26 that is located intermediate the opposite ends 22 of the base board 12 and proximate the forward edge 14. An access plate 28 is removably fastened to the underside of the base board 12 and covers the sensor cavity 26. The base board 12 also includes a bore 30 having an end communicating with the sensor cavity 26 and another end opening through the forward edge 14 of the base board 12. The base board 12 is preferably made of a hardwood, ideally mahogany.

The instrument 10 also includes (FIGS. 2 and 4) a heel rail 32 which is fixed to the upper surface 18 and which extends along the rearward edge 16 of the base board 12.

The instrument 10 also includes (FIGS. 2 and 3) a toe rail or tone board 34 which extends along the forward edge 14 of the base board 12 and is supported in spaced relation above the upper surface 18 by a pair of toe rail mounts 36. The tone board 34 is a resonant extension made of a non-ferro-magnetic material, preferably a hardwood. The toe rail 34 has opposite ends located adjacent the opposite ends 22 of the base board 12. A stack of neoprene washers 38 is located between each opposite end of the tone board 34 and the upper surface 18 of the base board 12. Each end of the tone board 34 is fixed to the base board 12 by a screw 39 (shown only in FIG. 5) extending through the base board 12, the neoprene washers 38 and the tone board 34. The neoprene washers 38 isolate vibrations in the tone board 34 from the base board 12.

The instrument 10 also includes (FIGS. 3 and 7) a flux plate 40 fixed to the underside of the tone board 34 intermediate the opposite ends of the tone board 34. The flux plate 40 is made of a ferro-magnetic material and is preferably rectangular and generally planar.

The base board 12 also includes (FIGS. 3 and 7) a sensor 42 that is fixed to the base board 12 and that provides a magnetic field extending through the flux plate 40. In particular, the sensor 42 includes a magnet 44 encapsulated by a housing 46 and a coil 48 surrounding the magnet 44. A pair of lead wires 50 connect the coil 48 to an outlet terminal 52, preferably a conventional amplifier jack, which is housed in the bore 30.

The tone board 34 and the base board 12, particularly the magnet 44 and flux plate 40, are arranged so that the flux plate 40 lies within and is encompassed by the magnetic field provided by the magnet 44. Also, the magnet 44 is oriented with respect to the flux plate 40 so as to provide opposite poles lying along an axis 54 that is generally normal to the plane in which the flux plate 40 lies.

The instrument 10 can be played as follows. A musician can tap or strike the tone board 34 with a hand, foot or drumstick. The impact on the tone board 34 will cause the tone board 34 to vibrate. Such vibratory movement of the tone board 34 entails movement of the flux plate 40 toward and away from the sensor 42 in the direction of the axis 54. Such movement of the flux plate 40 modifies the magnetic field.

The magnetic force which is exerted on the flux plate 40, and which emanates from the magnetic sensor 42 is inversely proportional to the square of the distance between the flux plate 40 and the magnetic sensor 42. Thus, when the flux plate 40 approaches the magnetic sensor 42, the magnetic field is affected with the square of the change in distance therebetween. As the air gap between the sensor 42 and the flux plate 40 changes, the reluctance of the flux path also changes, and this change generates a variation in the electrical current induced in the coil 48 and lead wires 50 which is then routed to the output terminal 52. This electrical signal is then used as an amplifier input.

It is believed that the signal generated by the playing of the instrument 10 is made more readily useable, in part, by the support, shape and orientation of the flux plate 28 relative to the magnet. In particular, the flux plate 28 iS supported by the tone board 34 which is made of a material that is not ferro-magnetic. Also, the flux plate 28 is supported by the tone board 34 so that the edges of the flux plate 28 are squared. This discontinuous flux conducting structure increases the density of the flux paths passing through the flux plate and inducing the signal, and results in a signal having a relatively high signal to noise ratio.

It is also believed that the electrical output of the sensor 42 includes high and mid-range frequencies that result from the complex vibrations of the tone board 34 and flux plate 28 within the flux path, and also includes low frequency components that result solely from the movement of the flux plate 40 toward the sensor 42 upon receiving an impact by the musician.

In the preferred embodiment, the dimensions of the base board 12 are approximately 26"×10"×1 ¾". The heel rail 32 is approximately 25 ½"×1 ⅛"×¾" and is also made of mahogany. The tone board 34 is also made of mahogany and has dimensions comparable to the heel rail 32. The tone board 34 is supported approximately 7/16" above the base board 12 by brass machine screws which are surrounded by the neoprene washers. The flux plate 40 is preferably made of a cold-rolled cadmium plated steel and measures 4"×¾"×⅛" and is centered over the magnetic sensor 42. Though different active or passive magnetic sensors may be appropriate for use as the sensor 42, a suitable sensor is manufactured by SSI Technologies, Inc., Model No. C-6066.6

Various features of the invention are set forth in the following claims.

I claim:

1. A musical instrument comprising:

a base board;

an elongated tone board mounted on the base board, the tone board having a first portion made of a material that is not ferro-magnetic and a second portion that is made of a ferro-magnetic material;

a sensor mounted on the base board and providing a flux path and an output terminal; and a damper located between the tone board and the base board for isolating vibrations in the tone board from the sensor.

2. A musical instrument as set forth is claim 1 wherein the tone board has opposite ends, and wherein the damper supports the opposite ends of the tone board in spaced relation to the base board.

3. A musical instrument as set forth in claim 1 wherein the base board has therein a cavity and the sensor is housed in the cavity.

4. A musical instrument as set forth in claim 1 wherein the first portion of the tone board includes a length of non-ferro-magnetic ferro-magnetic material and the second portion of the tone board is a plate fixed to the first portion.

5. A musical instrument as set forth in claim 1 wherein the sensor includes a magnet and a coil surrounding the magnet.

6. A musical instrument as set forth in claim 2 wherein the magnet provides opposed poles defining an axis and wherein the second portion of the tone board includes a planar surface that is normal to the axis.

7. A musical instrument comprising:

a base board;

a tone board mounted on the base board, the tone board having the first portion made of a material that is not ferro-magnetic and a second portion that is made of a ferro-magnetic material;

a sensor mounted on the base board and providing a flux path and an output terminal; and a damper located between the tone board and the base board for isolating vibrations in the tone board from the sensor.

8. A musical instrument as set forth is claim 7 wherein the tone board has opposite ends, and wherein the damper supports the opposite ends of the tone board in spaced relation to the base board.

9. A musical instrument as set forth in claim 7 wherein the base board has therein a cavity and the sensor is housed in the cavity.

10. A musical instrument as set forth in claim 7 wherein the first portion of the tone board includes a length of non-ferro-magnetic material and the second portion of the tone board is a plate fixed to the first portion.

11. A musical instrument as set forth in claim 7 wherein the sensor includes a magnet and a coil surrounding the magnet.

12. A musical instrument as set forth in claim 8 wherein the magnet provides opposed poles defining an axis and wherein the second portion of the tone board includes a planar surface that is normal to the axis.

* * * * *

UNITED STATES PATENT AND TRADEMARK OFFICE

CERTIFICATE OF CORRECTION

PATENT NO. : 5,627,336
DATED : May 6, 1997
INVENTOR(S) : William L. Stevens

It is certified that error appears in the above-indentified patent and that said Letters Patent is hereby corrected as shown below:

Claim 4, column 4, line 51, before "material" delete -- ferro-magnetic --

Signed and Sealed this

Twenty-second Day of July, 1997

Bruce Lehman

*Attest:*

BRUCE LEHMAN

*Attesting Officer*

*Commissioner of Patents and Trademarks*